US005653943A

United States Patent [19]

Arnold

[11] Patent Number: 5,653,943

[45] Date of Patent: Aug. 5, 1997

[54] VENTED STORAGE CONTAINER

[75] Inventor: Peter S. Arnold, Skipton, United Kingdom

[73] Assignee: Johnson & Johnson Medical, Inc., Arlington, Tex.

[21] Appl. No.: 418,322

[22] Filed: Apr. 7, 1995

[30] Foreign Application Priority Data

| | | | |
|---|---|---|---|
| Apr. 7, 1994 | [GB] | United Kingdom | 9406880 |
| Aug. 1, 1994 | [GB] | United Kingdom | 9415515 |

[51] Int. Cl.[6] ..... B65D 51/16

[52] U.S. Cl. ..... 422/102; 422/101; 422/104; 215/307; 222/481.5

[58] Field of Search ..... 422/99, 100, 101, 422/102, 103, 104, 265; 215/261, 307, 308; 222/481.5; 220/367.1, 202; 137/578

[56] References Cited

U.S. PATENT DOCUMENTS

| | | | |
|---|---|---|---|
| 3,845,787 | 11/1974 | Slagle | 215/307 Z |
| 4,120,414 | 10/1978 | Harrison et al. | 215/307 |
| 4,790,445 | 12/1988 | Shibata | 220/202 |
| 4,934,545 | 6/1990 | Pezzoli et al. | 215/250 |
| 4,935,371 | 6/1990 | Rickloff | 435/296 |
| 5,193,709 | 3/1993 | Brassell | 220/371 |
| 5,468,388 | 11/1995 | Goddard et al. | 210/321.75 |

FOREIGN PATENT DOCUMENTS

| | | |
|---|---|---|
| 0 453434 | 10/1991 | European Pat. Off. . |
| 2 063836 | 6/1981 | United Kingdom . |
| 2063836 | 6/1981 | United Kingdom . |

OTHER PUBLICATIONS

Search Reprot on Application No. GB 94115515.7 dated Oct. 5, 1994.

Derwent WPI. Abstract of GB 1529798, Originally Published Oct. 25, 1978.

*Primary Examiner*—Harold D. Pyon

[57] ABSTRACT

The invention provides a gas venting means for venting gases evolved by a liquid (2) enclosed inside a container (1). The means comprises a flexible tube (4) having a first end (5) venting to the exterior of the container (1) and a second end (10) extending into the container, the second end venting into the interior of the container through a semipermeable membrane (11). Preferably, the flexible tube (4) is provided with buoyancy elements near the second end (10) so that the semipermeable membrane is always exposed to the air space above the liquid in the container.

13 Claims, 1 Drawing Sheet

VENTED STORAGE CONTAINER

BACKGROUND OF THE INVENTION

The present invention relates to gas venting means for venting gases evolved by a liquid enclosed inside a container.

Certain liquids can present storage problems because they evolve substantially insoluble gases, such as oxygen, on prolonged storage. For example, the useful broad-spectrum disinfectant peracetic acid is often stored as a concentrate containing 10 to 20% w/v hydrogen peroxide and 5 to 50% w/v acetic acid in water. Gradual evolution of oxygen due to the slow decomposition of hydrogen peroxide on storage can result in an unacceptable build-up of pressure in sealed containers filled with this peracetic acid concentrate. Therefore, some means is needed to vent gases from such containers without allowing the escape of any liquid from the container, and without allowing contamination of the liquid inside the container from the environment. Moreover, the gas venting means should be able to resist corrosive liquids, such as peracetic acid, and should preferably be simple and inexpensive.

Conventional gas venting means include pressure release valves and membranes that rupture when a predetermined pressure is reached inside the container. The pressure release valves are complex, expensive, and contain metal parts that will corrode in the presence of liquids such as peracetic acid. The rupture membranes suffer from the drawback that, once the membrane has ruptured, liquid can escape from the container and environmental contaminants can enter the container through the ruptured membrane.

GB-A-1529798 describes a venting insert adapted to fit in a container entrance which can be closed by a detachable cover, the insert being adapted to vent gas from the container when the gas pressure exceeds a predetermined level. The insert includes at least one passage passing through it to allow fluids to be dispensed from the open container, and sealing means adapted to form with the cover a fluid-tight seal for the container. However, the sealing is yieldable to allow gas to escape from the passage to the atmosphere when the container gas pressure exceeds a predetermined level. This arrangement can be regarded as a type of pressure release valve. The drawback of this arrangement is that there is nothing to prevent liquid from inside the container being vented to the atmosphere, particularly if the container is inverted so that the venting insert is submerged in the liquid inside the container. Clearly, venting of the liquid from inside the container is undesirable, particularly if the liquid is a corrosive liquid such as peracetic acid.

GB-A-2203730 describes a venting cap for containers used to store volatile liquids. The cap contains a vent covered by first and second hydrophobic porous membranes. As a result, when the container is in an upright position and the cap is fixed, gases from inside the container can vent through the first and second hydrophobic porous membranes to the atmosphere. A drawback of the arrangement described in GB-A-2203730 is that the venting of gases from inside the container is prevented when the container is inverted. Hence, excessive build-up of gases inside the container is still possible with this venting cap.

EP-A-0453434 describes a gas venting outlet for a container used to store a viscous liquid which gives off a low-pressure gas by chemical reaction. The gas outlet consists of a cylindrical sleeve which projects into the container from the underside of the lid, with a hole through the lid in the centre of the sleeve. Inside the sleeve there is a second cylinder, with its solid base uppermost, and made of a resilient plastic material. The interior surface sleeve is provided with a helical groove. A helical channel is thereby defined between the outside surface of the second cylinder and the interior surface of the sleeve. Gas, but not liquid, can escape from the container through this helical channel. Clearly, this gas venting arrangement is not suitable for liquids of low viscosity, since liquids of low viscosity could vent along the spiral channel. Moreover, this venting arrangement would not be suitable if the container is tipped or inverted so as to immerse the gas outlet in the liquid.

SUMMARY OF THE INVENTION

Accordingly, object of the present invention is to provide a gas venting means for sealed liquid containers that provides for effective gas venting whatever the orientation of the container without allowing any of the liquid in the container to escape.

The present invention provides a gas venting means for venting gases evolved by a liquid enclosed inside a container, said means comprising a flexible tube having a first end venting to the exterior of the container and a second end extending into the container, the second end venting into the interior of the container through a semipermeable membrane.

The semipermeable membrane allows gases to vent out of the container through the tube, but prevents leakage of liquids from the container. The advantage of locating the semipermeable membrane at or near the end of a flexible tube extending into the container is that the tube can be configured so that at least part of the semipermeable membrane is normally exposed to gas in the gas pocket (air space) above the liquid when the container is incompletely filled. This results in much faster gas venting through the membrane than when the membrane is fully immersed in the liquid. In the latter case the rate of gas venting is constrained by the rate of diffusion and the solubility of the gas in the liquid. It will be appreciated that, if the semipermeable membrane were merely stretched across an aperture at the top of the container, then the membrane would be wholly immersed when the container is stored on its side or upside-down. The rate of venting of gas through the membrane might then be insufficient.

In the event that the liquid in the container is an aqueous liquid such as peracetic acid, the semipermeable membrane is preferably a hydrophobic membrane. Preferred materials for the semipermeable membrane include PTFE (polytetrafluoroethylene) and nylon. Particularly preferred semipermeable membranes are available from Gore under the trade name Vyon T.

Preferably, the flexible tube extending into the interior of the container is provided with buoyancy means near the second end. The buoyancy can, for example, be provided by flaring the tube near the second end. This also allows the use of a semipermeable membrane of larger area. Alternative preferred buoyancy means include a float, air collar or piece of closed-cell plastics foam. The flexibility of the tube allows the buoyancy means to bring the second end of the tube, and thereby the semipermeable membrane, to the surface of the liquid in the container when the container is tipped. This normally ensures that at least part of the semipermeable membrane is exposed to the gas in the gas pocket above the liquid in the container when the container is tipped or stored on its side.

Preferably, the flexible tube is branched inside the container, and the end of each branch vents into the interior of the container through a semipermeable membrane.

Preferably, each of the branches is provided with a buoyancy means as described above near its end. This arrangement can help to ensure that, whatever the orientation of the container, at least one semipermeable membrane is normally exposed to the gas in the gas pocket above the liquid in the container.

Preferably, the gas venting means is provided with a flange at the first end, the flange being of a size and shape to abut against the lip of an aperture of the container. For example, the aperture may be a neck at the top of the container for filling and emptying the container. In that case, the gas venting means is merely dropped into the neck after the liquid has been introduced into the container. A screw cap or similar closure is then secured over the aperture such that the flange forms a sealing engagement against the lip. (The screw cap or similar closure is permeable to gases vented through the tube).

In other preferred embodiments the first end of the tube is attached directly to a closure cap for the container. For example, the tube may extend inwardly from a hole in the centre of the closure cap.

A second semipermeable membrane may be provided in a vent in the cap to allow venting of gases through the cap when the container is in an upright position.

Preferably, the materials of both the tube and the semipermeable membrane are resistant to corrosive and/or oxidizing media, such as peracetic acid.

The present invention also provides a container comprising a gas venting means according to the present invention. Preferably, the container contains peracetic acid.

BRIEF DESCRIPTION OF THE DRAWINGS

Specific embodiments of the present invention will now be described further, by way of example, with reference to the accompanying drawings, in which.

PREFERRED EMBODIMENT OF THE INVENTION

Figure 1:
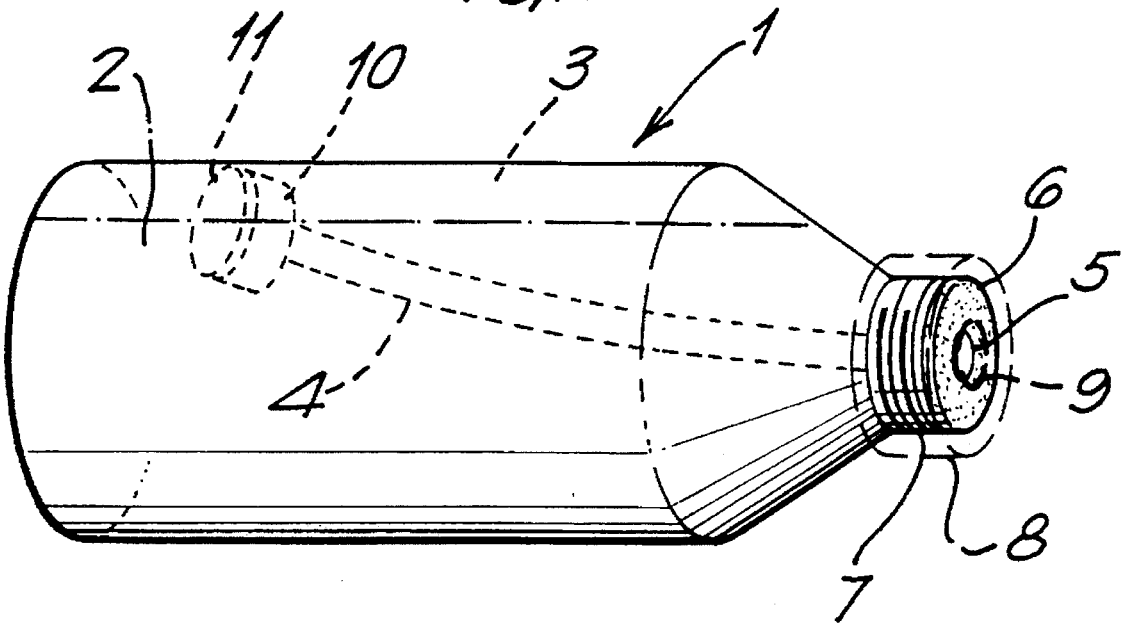
FIG. 1 shows a perspective view of a container provided with a gas venting means according to the present invention.

Referring to FIG. 1, the container (1) is shown resting on its side and partially filled with liquid peracetic acid solution (2). Gas evolved from the liquid (2) passes into gas pocket (3) above the liquid. A flexible tube (4) of PTFE extends into the container (1). A first end (5) of the flexible tube. (4) is provided with an integral PTFE flange (6) that abuts against the lip of the neck (7) of the container. The flange (6) is held in place, in sealing engagement with the said lip, by threaded closure cap (8) that screws onto the threaded neck (7) of the container. A hole (9) is provided in the centre of the closure cap (8).

A second end (10) of the flexible tube (4) vents into the interior of the container (1) through semipermeable membrane (11). The semipermeable membrane (11) is a PTFE membrane available from The Pall Corporation. The second end (10) of the flexible tube (4) is flared so as to provide additional buoyancy when the second end is immersed in the liquid (2).

In use, the second end (10) of the flexible tube (4) floats to the surface of the liquid (2) in the container. This exposes at least part of the surface of the semipermeable membrane (11) to the gas in the gas pocket (3). This gas can then vent rapidly through the tube (4) and through the hole (9) in the closure cap (8) to the atmosphere. Leakage of liquid from the container is prevented by the hydrophobic nature of the semipermeable membrane and the liquid-tight seal formed between the flange (6) and the lip of the neck (7) of the container (1). The flexible tube (4) is preferably sufficiently flexible for the second end (10) of the flexible tube always to be able to float up to the surface of the liquid, even when the container (1) is upright.

Figure 2:
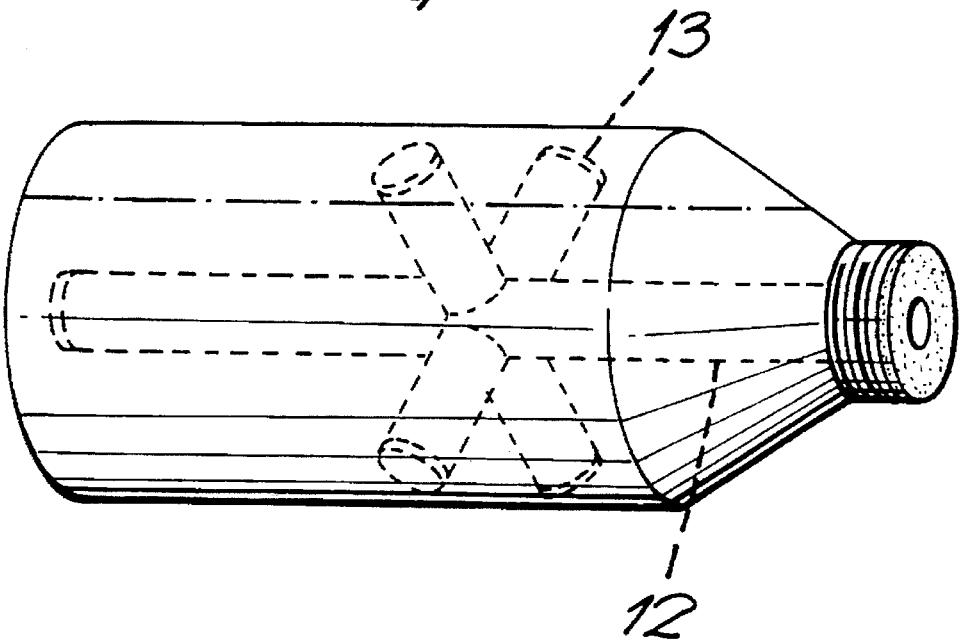
FIG. 2 shows a perspective view of a container provided with an alternative embodiment of the gas venting means according to the present invention.

Referring to FIG. 2, an alternative embodiment has a branched flexible tube (12) extending into the container. The end of each branch vents into the container through a semipermeable membrane (13). It can be seen that, with suitable arrangement of the branches, at least one of the semipermeable membranes is always exposed to the gas in the gas pocket above the liquid in the container. (The closure cap on the container has been omitted from FIG. 2 for the sake of clarity).

The above embodiments have been described by way of example only. Many other embodiments falling within the scope of the accompanying claims will be apparent to the skilled reader.

I claim:

1. A container having gas venting means for venting gases evolved by a liquid enclosed inside the container, said means comprising: a flexible tube having a first end venting to the exterior of the container and a second end extending into the container and positioned within a vapor space therein; a semipermeable hydrophobic membrane positioned at said second end of the flexible tube to inhibit the liquid in the container from entering the second end of the flexible tube and to allow gases within the container to enter the flexible tube through its second end and thereby to vent to the exterior of the container through the flexible tube; buoyancy means near the second end of the flexible tube; and a sterilant which evolves gases within the container.

2. A container according to claim 1, wherein the semipermeable membrane comprises polyvinylidenefluoride, polytetrafluoroethylene or nylon.

3. A container according to claim 1, wherein said flexible tube is branched so as to provide a plurality of said second ends, and a plurality of semipermeable membranes covers said plurality of second ends.

4. A container according to claim 1, wherein the said first end of said flexible tube is provided with a flange for abutting against a lip of an aperture in the container.

5. A container according to claim 1, wherein the said first end of the flexible tube is attached to a closure cap for the container.

6. A container according to claim 1, wherein the flexible tube and the semipermeable membrane are resistant to corrosive and/or oxidizing media.

7. A storage apparatus for storing liquids that evolve gas during storage, said storage apparatus comprising:

a container;

a flexible tube having a first end venting to the exterior of said container and a second end extending into the interior of said container;

a semipermeable hydrophobic membrane covering said second end of said flexible tube to inhibit egress of liquid inside said container through said flexible tube whilst allowing egress of gas from the interior of said container through said flexible tube; a sterilant which evolves gases within the container; wherein said flexible tube is branched inside said container, whereby said flexible tube has a plurality of branch ends inside said container with at least one the branch end above a liquid surface in the container; and wherein said storage container further comprises a plurality of semipermeable membranes covering each of said branch ends.

8. A storage apparatus according to claim 7, wherein said semipermeable membrane comprises polyvinylidenefluoride, polytetrafluoroethylene or nylon.

9. A storage apparatus according to claim 7, further comprising:

a lip surrounding an aperture in said container through which said flexible tube extends; and a flange on said first end of said flexible tube, said flange abutting against said lip.

10. A storage apparatus according to claim 7, further comprising:

an aperture in said container through which said flexible tube extends; and a closure cap fitted to said aperture, wherein said first end of said flexible tube is attached to said closure cap.

11. A storage apparatus according to claim 7, wherein said flexible tube and said semipermeable membrane are resistant to corrosive and/or oxidizing media.

12. A storage apparatus according to claim 7, further comprising peracetic acid stored inside said container.

13. A storage apparatus according to claim 7 wherein the sterilant comprises peracetic acid.

* * * * *

UNITED STATES PATENT AND TRADEMARK OFFICE

CERTIFICATE OF CORRECTION

PATENT NO. : 5,653,943
DATED : August 5, 1997
INVENTOR(S) : Peter S. Arnold

It is certified that error appears in the above-indentified patent and that said Letters Patent is hereby corrected as shown below:

Column 4 Line 64

"from the interior of said"

Should be

--from the interior to the exterior of said--

Signed and Sealed this

Ninth Day of December, 1997

*Attest:*

*Attesting Officer*

BRUCE LEHMAN

*Commissioner of Patents and Trademarks*